US007044897B2

(12) United States Patent
Myers et al.

(10) Patent No.: US 7,044,897 B2
(45) Date of Patent: May 16, 2006

(54) EXERCISE MACHINE WITH DUAL, COOPERATING WEIGHT STACKS

(75) Inventors: Clinton S. Myers, Smithfield, UT (US); Mike Olson, Logan, UT (US)

(73) Assignee: ICON IP, Inc., Logan, UT (US)

( * ) Notice: Subject to any disclaimer, the term of this patent is extended or adjusted under 35 U.S.C. 154(b) by 522 days.

(21) Appl. No.: 09/990,178

(22) Filed: Nov. 21, 2001

(65) Prior Publication Data

US 2003/0096681 A1 May 22, 2003

(51) Int. Cl.
*A63B 21/62* (2006.01)

(52) U.S. Cl. ..... 482/99; 482/138

(58) Field of Classification Search ..... 482/98–103, 482/138
See application file for complete search history.

(56) References Cited

U.S. PATENT DOCUMENTS 4,154,441 A * 5/1979 Gajda ..... 482/102
4,349,192 A * 9/1982 Lambert et al. ..... 482/101
4,540,171 A 9/1985 Clark et al.
4,627,615 A * 12/1986 Nurkowski ..... 482/98
4,635,926 A 1/1987 Minkow
4,648,594 A * 3/1987 Schleffendorf ..... 482/102
4,834,365 A * 5/1989 Jones ..... 482/100
4,898,381 A 2/1990 Gordon
4,974,838 A 12/1990 Sollenberger
5,776,040 A 7/1998 Webb et al.
5,951,444 A * 9/1999 Webber ..... 482/99
6,095,954 A * 8/2000 Svanberg ..... 482/99
6,719,672 B1 * 4/2004 Ellis et al. ..... 482/99

OTHER PUBLICATIONS

Owner's Manual for Impex Fitness Products *Powerhouse Home Gym WM 1400*, Revised Jun. 30, 2000.
Website page for Impex, dated Nov. 6, 2001.
Website pages (16 pp.) for Impex dated Dec. 11, 2001.

* cited by examiner

*Primary Examiner*—Stephen K. Cronin
*Assistant Examiner*—Victor K. Hwang
(74) *Attorney, Agent, or Firm*—Workman Nydegger

(57) ABSTRACT

An exercise apparatus has an exercise station that is selectively moved by a user and has first and second weight stacks that provide selected resistance to movement of the exercise station. The exercise apparatus includes: (A) a frame; (B) an exercise station; (C) a first weight stack; (D) a second weight stack; and (E) a coupling system configured to selectively couple: (i) the first weight stack; and (ii) the second weight stack to the exercise station such that movement of the exercise station requires movement of at least one plate from each of: (i) the first weight stack; and (ii) the second weight stack. A coupling member couples the first weight stack to the second weight stack.

22 Claims, 10 Drawing Sheets

EXERCISE MACHINE WITH DUAL, COOPERATING WEIGHT STACKS

BACKGROUND OF THE INVENTION

1. Field of the Disclosure

The present disclosure relates to exercise equipment. More particularly, the present disclosure relates to exercise systems having multiple resistance assemblies, such as multiple weight stacks, which provide exercise resistance.

2. Background and Relevant Art

There exist a variety of apparatuses for exercising various portions of a body. Some apparatuses specifically engage only the arms or legs, for example. Other apparatuses are more varied in functionality, able to engage various muscle systems with different components and exercise actions. Examples of apparatuses embodying one or more component in the same general apparatus include weight systems having a weight stack.

Weight systems typically employ a cable and pulley system that engages a weight stack as part of an exercise motion. The cables(s) and pulley(s) within a particular weight system are often designed so that a certain weight stack may be accessed from different angles, and from different exercise stations. For example, one cable and pulley system may connect from a leg press station to a weight statck. Alternatively, a second cable and pulley system may lift the same weight stack from, for example, a second station, such as a bench press exercise station.

At least one advantage of such a setup is that multiple stations may be situated adjacent to each other on the same system, thereby creating a multi-functional, yet compact workout environment. As a result of such space saving orientations, certain weight systems may be ideal for both home and commercial use.

However, at least one disadvantage to typical weight systems is that the amount of weight that can be lifted is limited to the single weight stack on the exercise apparatus. The single weight stack often has a limited vertical path such that adding additional weights to the stack may decrease a desired range of motion experienced by an exerciser. Compounding this problem is the fact that it is often desirable to utilize weights having varying mass increments, thereby providing additional choice and selection. Moreover, as a user becomes more experienced with an exercise routine, a greater amount of resistance may be desired.

Another disadvantage of prior systems is that some systems are limited to only one user at a time. Despite the fact that many systems may embody more than one exercise station, some systems have each station operating on one central weight stack.

Another disadvantage is that different muscles in a human body are capable of lifting different amounts of weight. For example, a person may be able to "press" more weight with his or her legs than he or she can lift with their arms. Thus, the person may have more than enough total weight in a given exercise system for arm exercises, but not enough for leg exercises.

In light of these and other disadvantages with prior systems, there exists a need for an improved exercise system. For example, there exists a need for a compact exercise system suited for lifting an increased range of resistance compared with prior systems. In addition, there exists in the art a need for an improved exercise system capable of servicing more than one user. Furthermore, there exists in the art a need for an improved weight system capable of providing a user a variable amount of resistance.

BRIEF SUMMARY OF THE INVENTION

It is therefore an object of the invention to provide an improved exercise system.

Another object of the present invention is to provide an improved weight system.

Another object of the present disclosure is to provide an improved weight system that more efficiently utilizes weights so that a user may lift more weight without necessarily adding more weights to the system.

Another object of the invention is to allow a user of a weight system to lift a first weight stack, and if desired, a second weight stack located on the weight system.

Another object of the invention is to allow first and second users to use different weight stacks in an exercise machine.

Another object of the disclosure is to provide a weight system capable of simultaneous use by different users.

Another object of the invention is to allow a user to lift a first and second weight stack using a first exercise station and to allow the same user or a second user to lift the same weight stacks using a second exercise station.

The present invention relates to an exercise apparatus having one or more exercise stations that is selectively moved by a user and has first and second resistance assemblies, e.g., weight stacks, coupled thereto. The weight stacks provide selected resistance to movement of the exercise station(s). The exercise apparatus comprises: (A) a frame; (B) an exercise station; (C) a first weight stack; (D) a second weight stack; and (E) a coupling system configured to couple the first weight stack to an exercise station and to couple a second weight stack to the first weight stack, such that movement of the exercise station requires movement of at least a portion from each of: (i) the first weight stack; and (ii) the second weight stack. A second exercise station is also selectively coupled to at least one of the weight stacks, and in one embodiment, to both weight stacks.

Since the first and second weight stacks can be coupled to a single exercise station, a user may lift more weight without requiring a taller single stack and without adding weights to the stack. In addition, different weight distribution schemes may be employed. For example, one weight stack may comprise several weights of smaller mass increments, and a second weight stack may comprise fewer weights of larger mass increments.

In one embodiment, at the user's option, both weight stacks maybe engaged simultaneously, or the first or second weight stack may be employed independently from the other stack.

Since exercise stations in the weight system station are capable of simultaneously engaging more than one weight stack, the weight system is further able to service a broader ability range of users. That is, when a less experienced user prefers to utilize only one weight stack while performing an exercise, a more experienced user may prefer to utilize two weight stacks for performing the same exercise. The present system accommodates both ability types without requiring at least one weight stack of greater than average weight or height.

Since various exercise stations can be employed and since a single exercise station will pick up one or both weight stacks, the exercise system is highly efficient, compact and useful for one or a plurality of users. In one embodiment, the first weight stack is selectively coupled to the second weight stack.

These and other objects, features and advantages of the present disclosure are set forth in the description that follows, and in part may be more apparent from the detailed description of preferred embodiments, or from the appended claims, or learned by actual practice of the disclosure.

BRIEF DESCRIPTION OF THE DRAWINGS

In order that the manner in which the disclosure, as well as advantages and objects, of the disclosure are obtained, a more particular description of the disclosure briefly described above will be rendered by reference to specific embodiments thereof that are illustrated in the appended drawings. Understanding that these drawings depict only typical embodiments of the disclosure and are not therefore to be considered to be limiting of its scope, the invention will be described and explained with additional specificity and detail through the use of the accompanying drawings in which.

DETAILED DESCRIPTION OF EMBODIMENTS

Figure 1A:
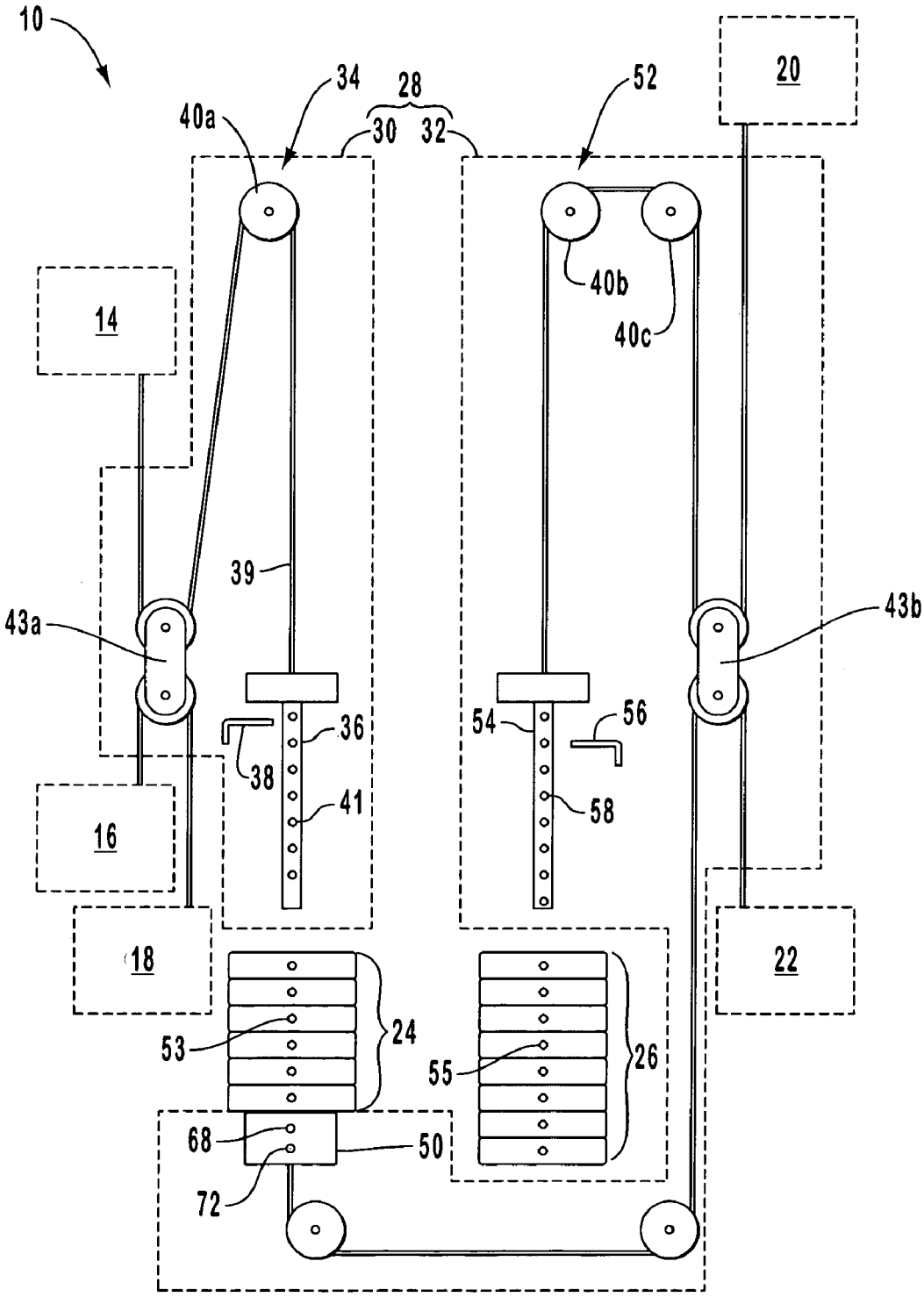
FIG. 1A is a schematic view of an embodiment of an exercise apparatus of the present invention featuring a first weight stack, a second weight stack, a first attachment system shown within dashed lines, a second attachment system shown within dashed lines, and a plurality of exercise stations, each represented schematically by dashed block diagrams.
Figure 1B:
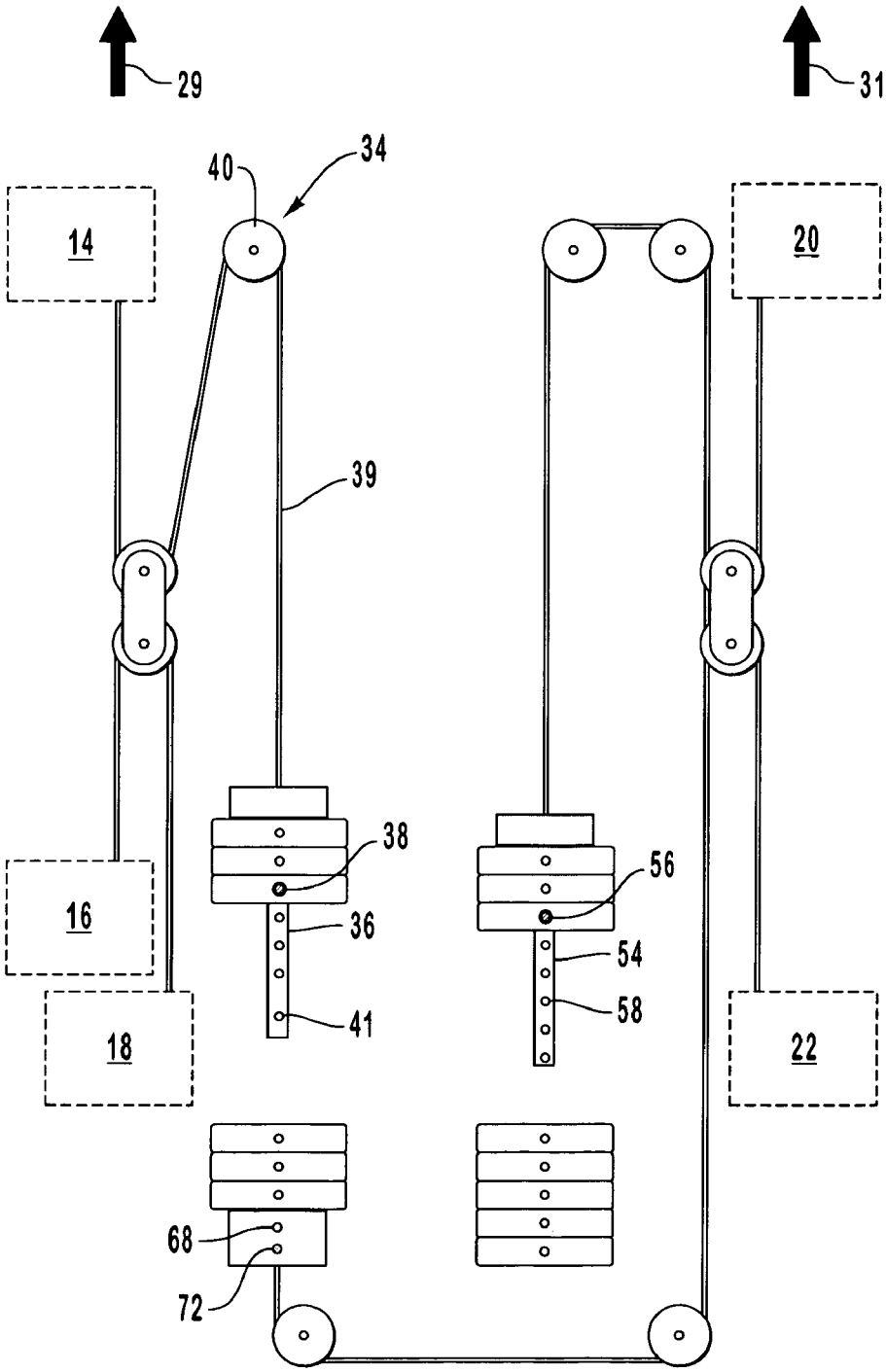
FIG. 1B is a schematic view of the apparatus of FIG. 1A demonstrating the movement of the first and second weight stacks as respective first and second exercise stations are moved with the first and second coupling pins mounted in respective third weight plates.
Figure 1C:
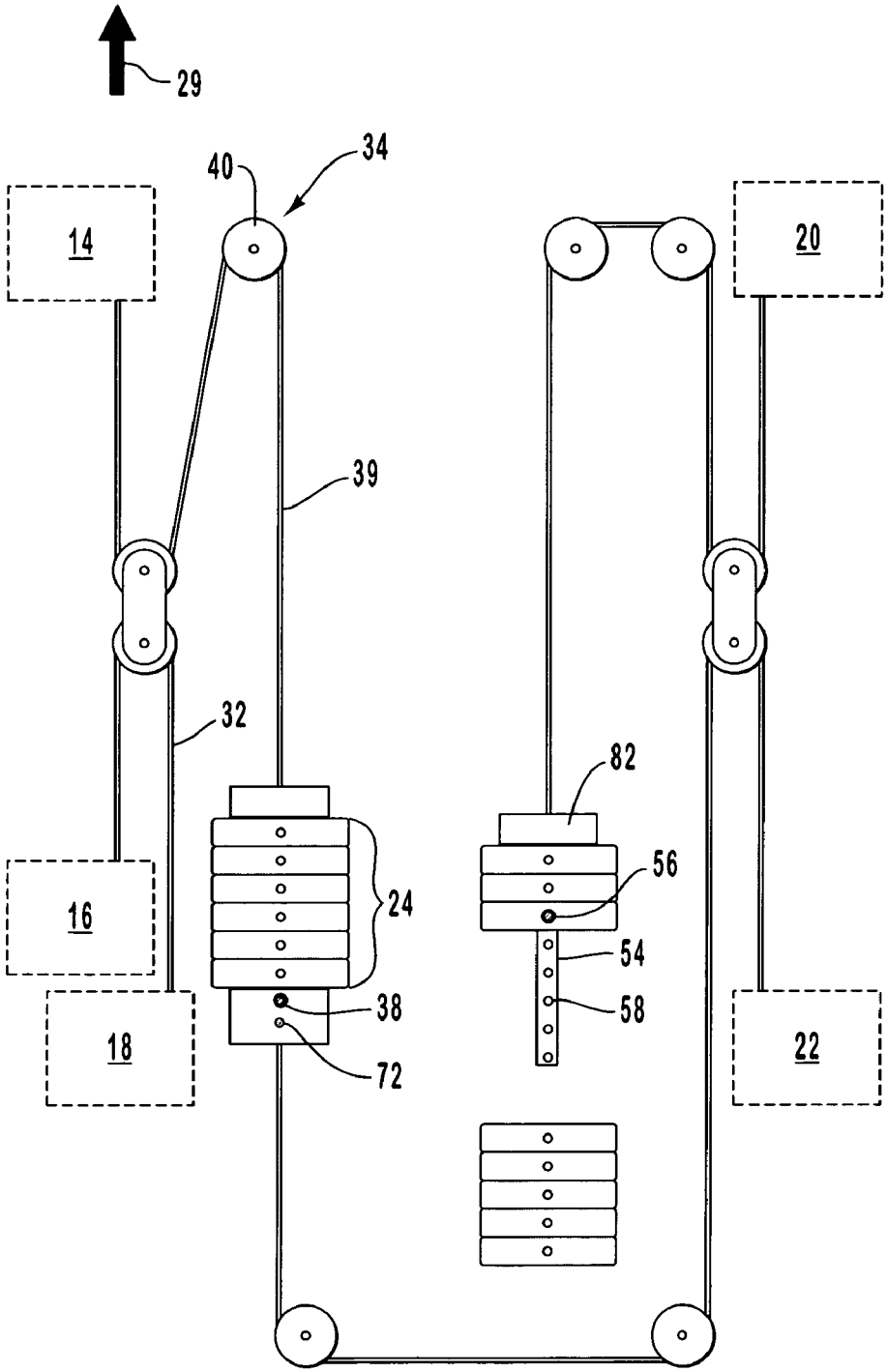
FIG. 1C is a schematic view of the apparatus of FIG. 1A demonstrating the movement of both the first and second weight stacks as only one exercise station is moved while a coupling pin is mounted in a coupling member.
Figure 2:
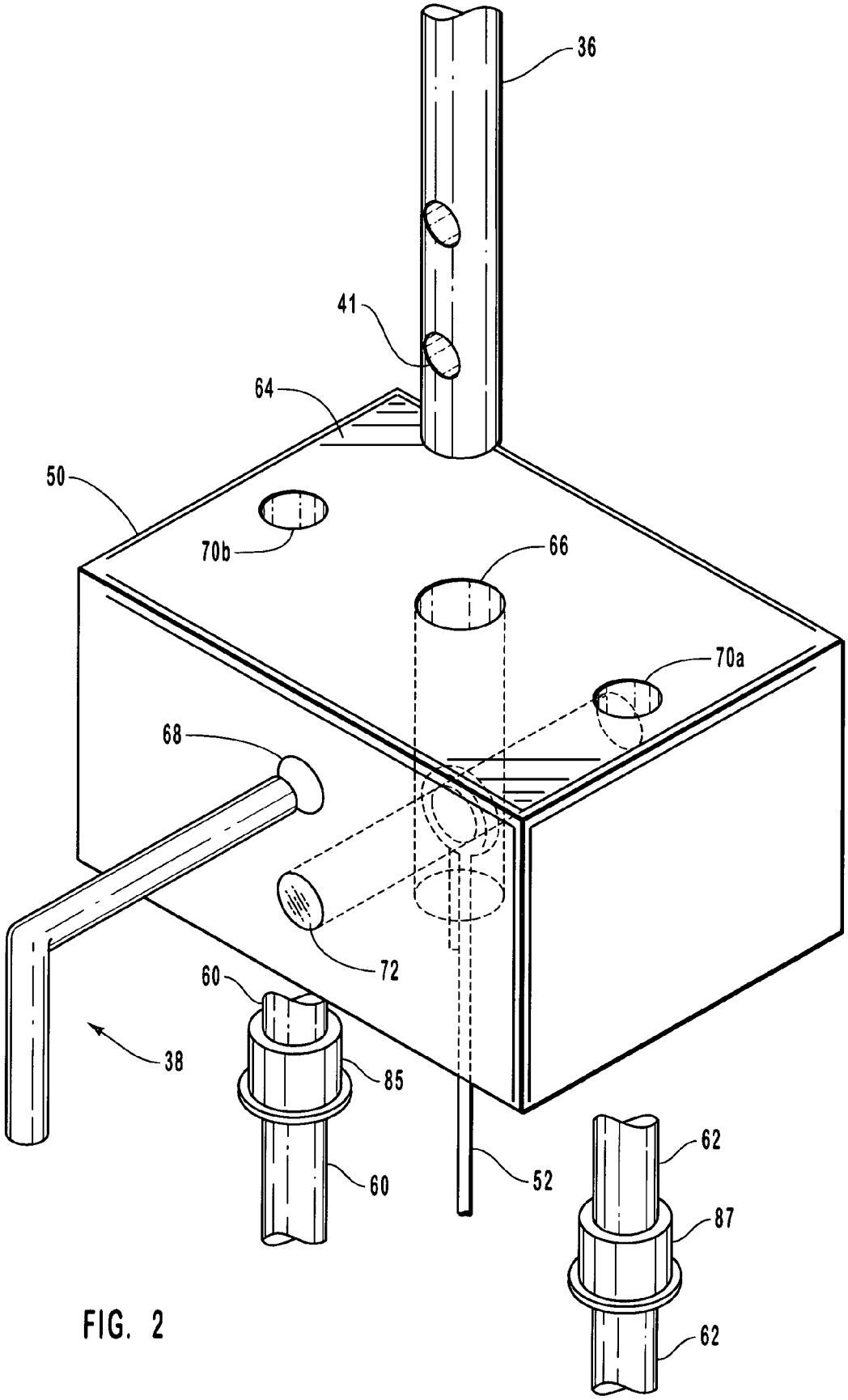
FIG. 2 is a perspective view of a coupling member of the present invention. A perforated selector rod is shown exploded above the coupling member and a selector pin that is selectively mounted therein is shown. A horizontally oriented retaining pin 72 is also shown in a partially phantom view within the coupling member with a portion of a cable of an attachment system (also shown partially in phantom lines) attached thereto.
Figure 3:
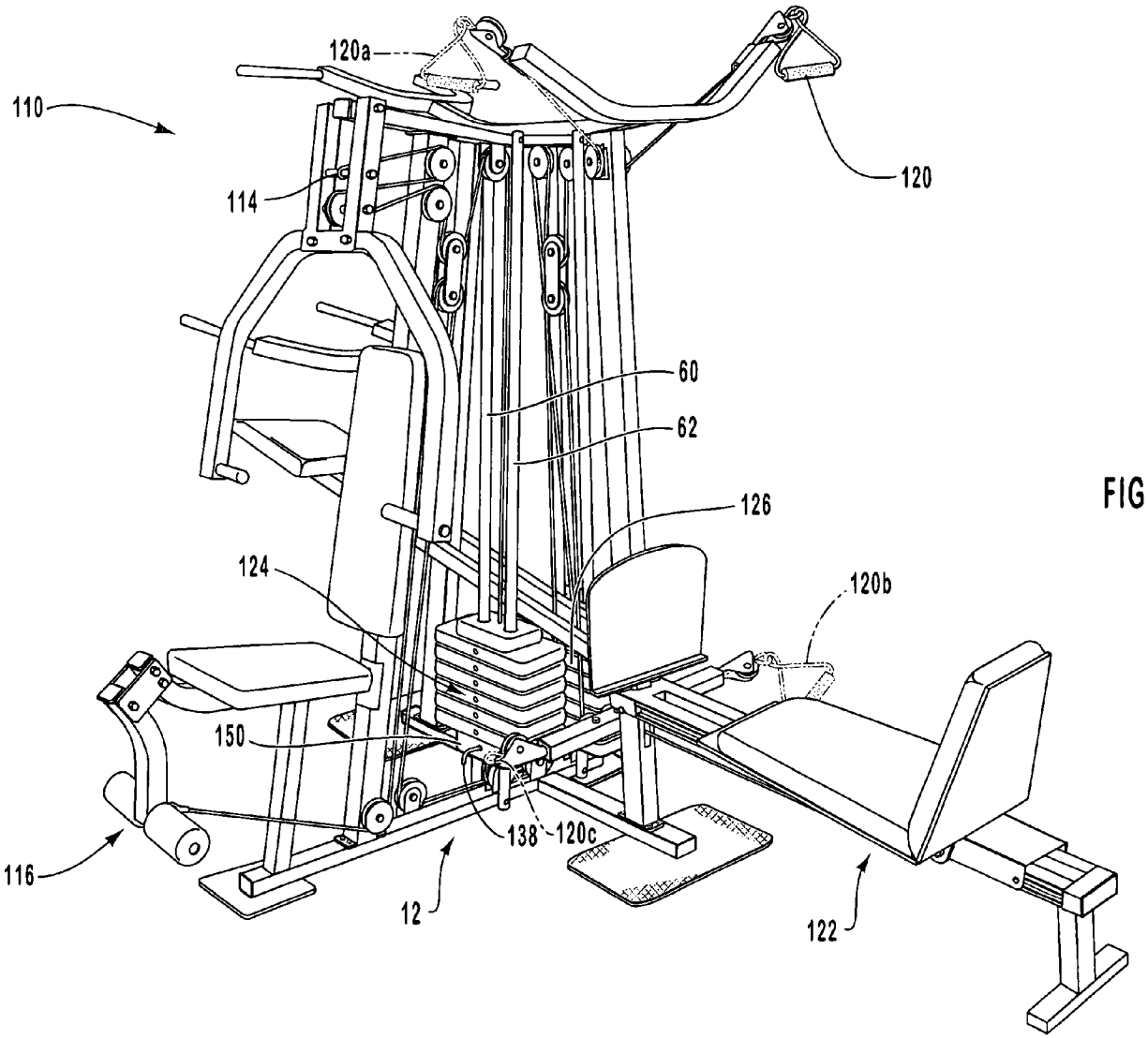
FIG. 3 is a general perspective view of an assembled weight of the present invention as described in a schematic view with respect to FIGS. 4A–4E. Possible additional exercise stations are also shown in phantom lines.

With reference now to the Figures, an exercise apparatus 10 of the present invention will be discussed in additional detail. FIGS. 1A–1C are schematic views of a first exercise apparatus and FIGS. 4A–4E are schematic views of a second exercise apparatus. FIG. 2 is a perspective view of a coupling member employed in the apparatus of FIGS. 1A–1C and/or the apparatus of FIGS. 4A–4E. FIG. 3 is a perspective view of one example of an assembled exercise apparatus employing certain features of the present invention.

FIGS. 1A–1C are schematic views of the operation of one embodiment of an exercise apparatus 10 of the present invention. These figures do not illustrate a frame 12 of exercise apparatus 10. However, an example of frame 12 of apparatus 110 is shown in FIG. 3. Frame 12 may be employed for the exercise apparatus 10 of FIGS. 1A–1C. A variety of other frames may be employed.

In addition to frame 12, exercise apparatus 10 comprises at least one and preferably a plurality of exercise stations, 14, 16, 18, 20, and/or 22, as shown schematically in FIG. 1A. Each dashed-lined block diagram (e.g., 14, 16, 18, 20, or 22) represents an example of a possible exercise station. The exercise station may comprise one or more of a variety of different stations. Examples of such an exercise station include a rigid or flexible handle grasped by a user, an arm press mechanism, a leg press or curl mechanism, an arm curl bar, a pull-down bar, a pull-up bar, an arm cuff or collar, a leg cuff or collar, a bench press bar, a butterfly mechanism, a rotating mechanism, a sliding mechanism, a lifting mechanism, a stepper mechanism, a padded member or mechanism, a harness, a lifting assembly, or another bar, handle, or mechanism that is contacted by a portion of a person's body for purposes of exercise, for example. Exercise stations may include, for example, any member or mechanism that is contacted by the arm, hand, leg, foot, head, neck, abdomen, chest, thigh, calf, knee, hip, upper torso, lower torso, back, shoulder or other portion of a person's body in order to exercise a portion of the body. While one embodiment of the invention can be carried out with a single exercise station, e.g., station 14, the preferred embodiment features a plurality of stations at which an exerciser can exercise.

Apparatus 10 further comprises a first weight stack 24 and a second weight stack 26. Each weight stack 24, 26 comprises at least one weight plate and preferably comprises a plurality of vertically stacked weight plates, as shown. Each of the weight stacks 24, 26 moves along a different vertical axis, also as shown.

Coupling system 28 is configured to selectively couple first weight stack 24 and second weight stack 26 to a single exercise station. Weight stacks 24, 26 can be collectively coupled to, and therefore moved by, exercise station 14, 16 or 18.

Alternatively, as shown in FIG. 1B, first weight stack 24 can be selectively coupled to, and therefore moved by, exercise station 14, 16 or 18 while second weight stack can be selectively coupled to, and therefore moved by exercise station 20 or 22. As depicted in FIG. 1B, one stack 24 can serve as a resistance assembly that resists movement (see arrow 29) of one exercise station, e.g., station 14, 16 or 18, while another stack 26 is used by a different user as a resistance assembly that resists movement (see arrow 31) of a separate, independent exercise station, such as station 20 or 22. As depicted in FIG. 1B, each weight stack 24 can be moved independently from weight stack 26.

FIG. 1B is a schematic view of the apparatus of FIG. 1A demonstrating the movement of the first and second weight stacks 24, 26 as respective exercise stations (e.g., 14 and 20) are moved with the first and second coupling pins 38, 56 mounted in respective third weight plates. Thus, a first user may use one exercise station, e.g., station 14 coupled to first weight stack 24, while a second user uses another exercise station, e.g., station 20 coupled to second weight stack 26, as shown in FIG. 2.

However, as depicted in FIG. 1C, by employing coupling system 28, each of the first and second weight stacks 24 and 26 can be employed to act as resistance to movement (see arrow 29) of a single exercise station, such as station 14, 16 or 18. Apparatus 10 is thus highly efficient. Exercise station 14 may be coupled to first weight stack 24, and, if additional resistance is desired, to second weight stack 26 as well. Consequently, a single user may employ the resistance afforded by both weight stacks 24 and 26.

As another advantage to this system, rather than requiring the first stack to have so many weights that the vertical height through which the stack can move is limited, the first stack can have a certain number of weights while the second stack has another set of weights, thereby allowing the user to experience the same amount of a resistance as a single tall stack. As yet another advantage, one weight stack may employ weights having one increment, e.g., ten pound increments, while another stack employs five pound increments, thereby allowing the user to more precisely select a desired amount of weight.

Returning to FIG. 1A, as mentioned, coupling system 28 is configured to selectively couple first weight stack 24 and second weight stack 26 to an exercise station, e.g. station 14. Coupling system 28 comprises: (i) a first attachment system 30; and (ii) a second attachment system 32. The components of each of the first and second attachment systems 30, 32 are generally depicted within respective dashed lines of FIG. 1A.

First attachment system 30 selectively couples an exercise station (e.g., station 14) to first weight stack 24. Second attachment system 32 selectively couples first weight stack 24 to second weight stack 26 such that movement of first weight stack 24 requires movement of second weight stack 26.

First attachment system 30 comprises: (i) a first cable and pulley system 34 coupled to the frame 12; (ii) a first selector rod 36 coupled to first cable and pulley system 34; and (iii) a first selector pin 38 selectively mounted in one of a plurality of apertures 41 within first selector rod 36 once rod 36 is disposed within weight stack 24. First cable and pulley system 34 comprises a cable 39 and one or more pulleys, e.g., 40*a–c*. Different numbers or types of pulleys than those shown may be employed in order to perform the functions described herein. First selector rod 36 is configured to be extended within first weight stack 24 and member 50 and has a plurality of apertures 41, each configured to receive first pin 38 therein. First pin 38 is selectively mounted in first selector rod 36 when first selector rod 36 is extended within weight stack 24 and/or coupling member 50.

Second attachment system 32 comprises: (i) first coupling member 50 mounted beneath first weight stack 24 and selectively coupled to first selector rod 36, (ii) a second cable and pulley system 52 coupled to the first coupling member 50 and frame 12; (iii) a second selector rod 54 coupled to second cable and pulley system 52; and (iv) a second pin 56 selectively mounted in one of a plurality of apertures 58 in second selector rod 54 when rod 54 is extended within second weight stack 26. In order to couple first weight stack 24 to second weight stack 26, the second attachment system 32 also comprises an additional selector pin that is selectively placed within coupling member 50. First selector pin 38 (or a third selector pin—not shown) may fulfill this function by being mounted in coupling member 50.

Second selector rod 54 is configured to be extended within second weight stack 26 and has a plurality of apertures 58 configured to receive second pin 56 therein. Different numbers or types of pulleys from those shown in system 52 may be employed in order to perform the functions described herein.

Coupling member 50 is configured to receive first selector rod 36 within an aperture extending vertically through the top of coupling member 50. Coupling member 50 is also configured to receive pin 38 within a side aperture 68 thereof that intersects with the top aperture. Pin 38 can thus be selectively mounted within selector rod 36 to thereby couple coupling member 50 to selector rod 36 beneath weight stack 24, as shown in FIG. 1C. As shown in FIGS. 1A–1C, coupling member 50 is positioned below first weight stack 24 and moves vertically with first weight stack 24 when coupling member 50 is coupled to first selector rod 36.

Also as shown in FIG. 1C, when desired by an exerciser, movement (see arrow 29) of a single exercise station, e.g., station 14 requires movement of at least one plate from each of first weight stack 24; and (ii) second weight stack 26. For example, an exerciser performing an arm press using exercise station 14 may desire to increase the amount of resistance in addition to that provided by weight stack 24. Upon so desiring to increase the amount of weight beyond that of stack 24, the exerciser may mount coupling pin 38 within coupling member 50 (and thus, selector rod 36) in order to be able to connect weight plates from second weight stack 26 to first weight stack 24. Upon mounting first coupling pin 38 within coupling member 50 and rod 36, and upon mounting second coupling pin 56 within second weight stack 26 and rod 54, as shown in FIG. 1C, both the first and second weight stacks 24, 26 can be moved merely by moving a single exercise station, such as station 14, 16, or 18.

The plates of stacks 24, 26 and the coupling member 50 are each configured to receive a selector rod therein. Coupling member 50 and each plate in the first and second weight stacks 24, 26 have a top, vertical selector rod aperture extending therethrough. Each top, vertical selector rod aperture aligns with a respective horizontal side aperture, e.g., 68, 53, 55. Each coupling pin extends through a respective horizontal aperture to couple within a desired selector rod aperture.

Although not depicted in FIGS. 1A–1C, each weight plate in stacks 24, 26 further has a pair of vertical guide rod apertures. The apertures are located on opposing sides of a respective selector rod aperture. Each guide rod aperture is configured to receive a corresponding vertical guide rod 60, 62 (see FIG. 3) therein. Thus, the plates in the first and second weight plate stacks 24, 26 remain aligned as the plates move vertically along their respective guide rods when being moved upwardly and downwardly. Member 50 also has guide rod apertures that align with respective weight plate guide rod apertures such that member 50 remains aligned with the weights in stack 24.

Coupling system 28 is an example of means for coupling a first resistance assembly (e.g., weight stack 24) to an exercise station and for coupling a second resistance assembly (e.g., weight stack 26) to the first resistance assembly, such that movement of the exercise station requires movement of at least a portion (e.g., a plate) from each of: (i) the first resistance assembly; and (ii) the second resistance assembly.

Thus, in the embodiment of FIGS. 1A–1C, first coupling member 50 is positioned adjacent first weight stack 24 and conveniently enables the coupling of second weight stack 24 to first weight stack 26, avoiding the use of a complicated, expensive assembly.

First coupling member 50 is shown in additional detail in FIG. 2. First coupling member 50 comprises (i) a member body 64 (which may be in the form of a block, as shown for example), (ii) a central top, vertical selector rod aperture 66 (which, in one embodiment extends through body 64, as shown in dashed phantom lines), (iii) a horizontal, side aperture 68 in fluid communication with top, vertical aperture 66 and configured to align with an aperture 41 of selector rod 36, and (iv) opposing guide rod apertures 70*a–b*.

As can be seen from a review of FIG. 2, member 50 is selectively coupled to selector rod 36 through the use of coupling pin 38. Member 50 further comprises a cable system retaining pin 72 extending therethrough to which cable and pulley system 52 of second attachment system 32 is coupled, as shown partially in phantom lines. In the embodiment of FIG. 2, pin 72 intersects aperture 66 and a portion of cable and pulley system extends within aperture 66.

Coupling member 50 can serve as a weight to thereby add to the weight of stack 24. Therefore, coupling member 50 can serve to add weight to stack 24 even if weights from stack 26 are not selected.

As mentioned above, guide rods 60, 62 (FIG. 3) extend through the weight plates of each of stacks 24, 26. Guide rods 60, 62 (see FIGS. 2 and 3) also extend through respective apertures 70*b*, 70*a* in coupling member 50. Guide rods 60, 62 are shown in a cutaway view in FIG. 2. As depicted in FIG. 2, in one embodiment, the lower portion of guide rods 60, 62 has stops 85, 87 mounted thereon. Stops 85, 87 (which may comprise an elastomeric cushioning material on the upper portions thereof) are configured to maintain member 50 above a support surface such that one or more pulleys (and/or one or more cables) can be mounted beneath member 50, as depicted by way of example with respect to coupling member 150 (which may be similar or identical to member 50) in FIG. 3. Member 50 contacts stops 85, 87 as it moves downwardly during an exercise routine and rests on stops 85, 87 when the exercise machine is not in use.

In one embodiment, the upper pulleys, e.g., pulleys 40*a–b* are rotatably affixed to frame 12, while the dual pulley bracketed mechanisms, e.g., mechanisms 43*a–b* are supported by cables extending through their respective pulleys. However, as mentioned, a vast number of other cable and pulley configurations may be employed as part of a respective cable and pulley system in order to achieve the functions described herein.

FIG. 3 is a general perspective view of another weight system 110 of the present invention as described in a schematic view with respect to FIGS. 4A–4E. Exercise apparatus 110 of FIG. 3 and FIGS. 4A–4E features a dual coupler system that enables multiple weight stacks to be lifted from either exercise stations 114 or 116, which are linked to first cable and pulley system 134, or stations 120 or 122, which are linked to second cable and pulley system.152.

Figure 4A:
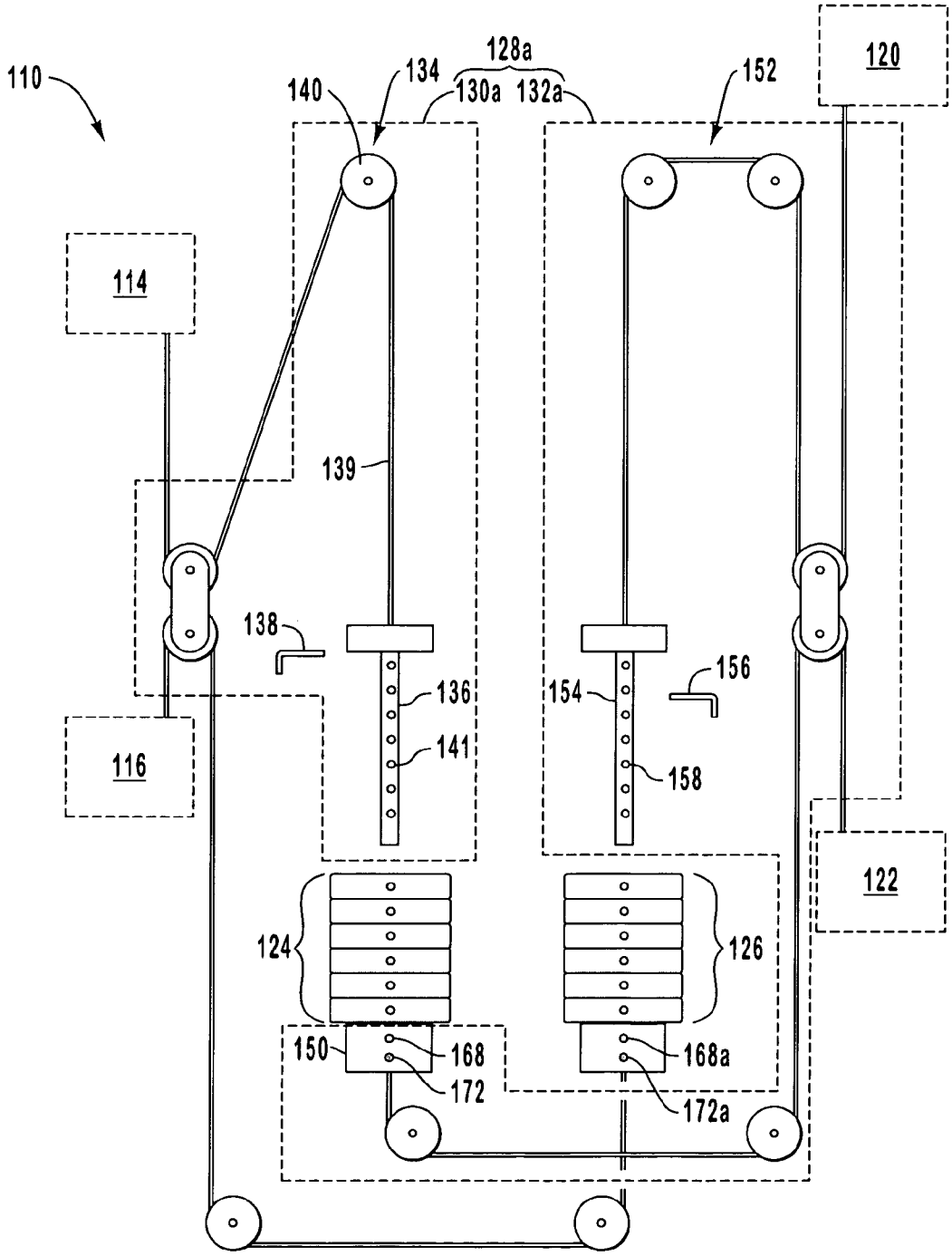
FIG. 4A is a schematic view of an alternative embodiment of an exercise apparatus of the present invention featuring first and second coupling members such that each weight stack has a coupling member adjacent thereto and such that a plurality of exercise stations can lift each weight stack. The coupling system 128*a* allows first exercise station 114 to move both weight stacks.

FIGS. 4A–4E do not show a frame of exercise apparatus 110. However, the frame of exercise apparatus 110 may be configured similarly to frame 12 of FIG. 3, for example. In addition to the frame, exercise apparatus 110 comprises at least one and preferably a plurality of exercise stations, as shown in FIG. 4A. Stations 114, 116, 120, and 122, represent examples of such exercise stations, which may comprise a variety of different stations, such as those discussed above, for example.

Apparatus 110 further comprises a first weight stack 124 and a second weight stack 126. Each weight stack 124, 126 comprises at least one weight plate and preferably comprises a plurality of vertically stacked weight plates, as shown. Each of the weight stacks 124, 126 moves along a different vertical axis, also as shown. Weight stacks 124, 126 may be the same as or similar to weight stacks 24, 26, respectively discussed above.

Figure 4B:
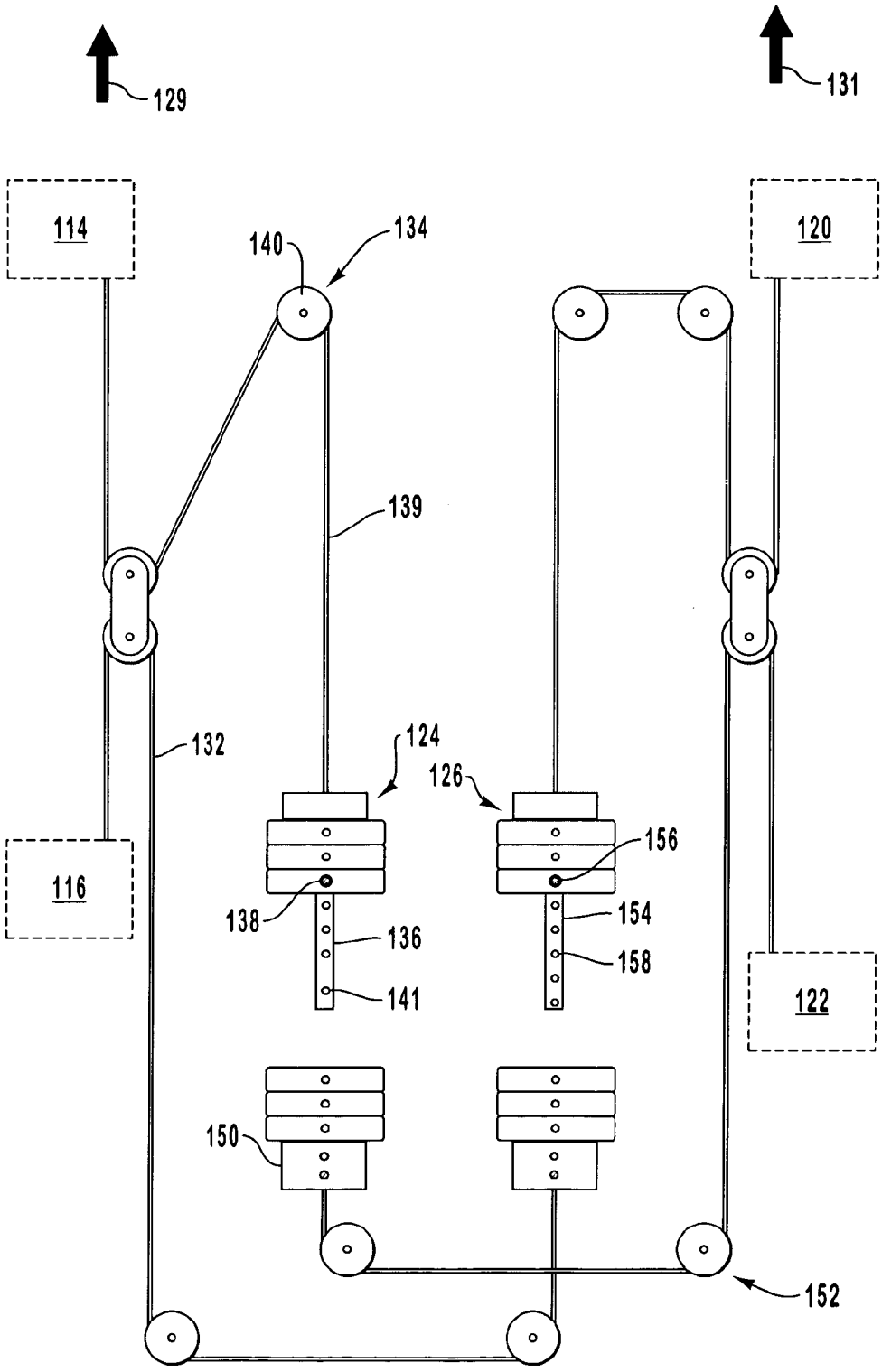
FIG. 4B is a schematic view of the apparatus of FIG. 4A demonstrating the movement of the first and second weight stacks as respective first and second exercise stations are moved with the first and second coupling pins mounted in respective third weight plates.

As shown in FIG. 4B, one stack 124 can serve as resistance for one exercise station, e.g., station 114, while another stack 126 is used by a different user as resistance for a separate exercise station, such as station 120.

Figure 4C:
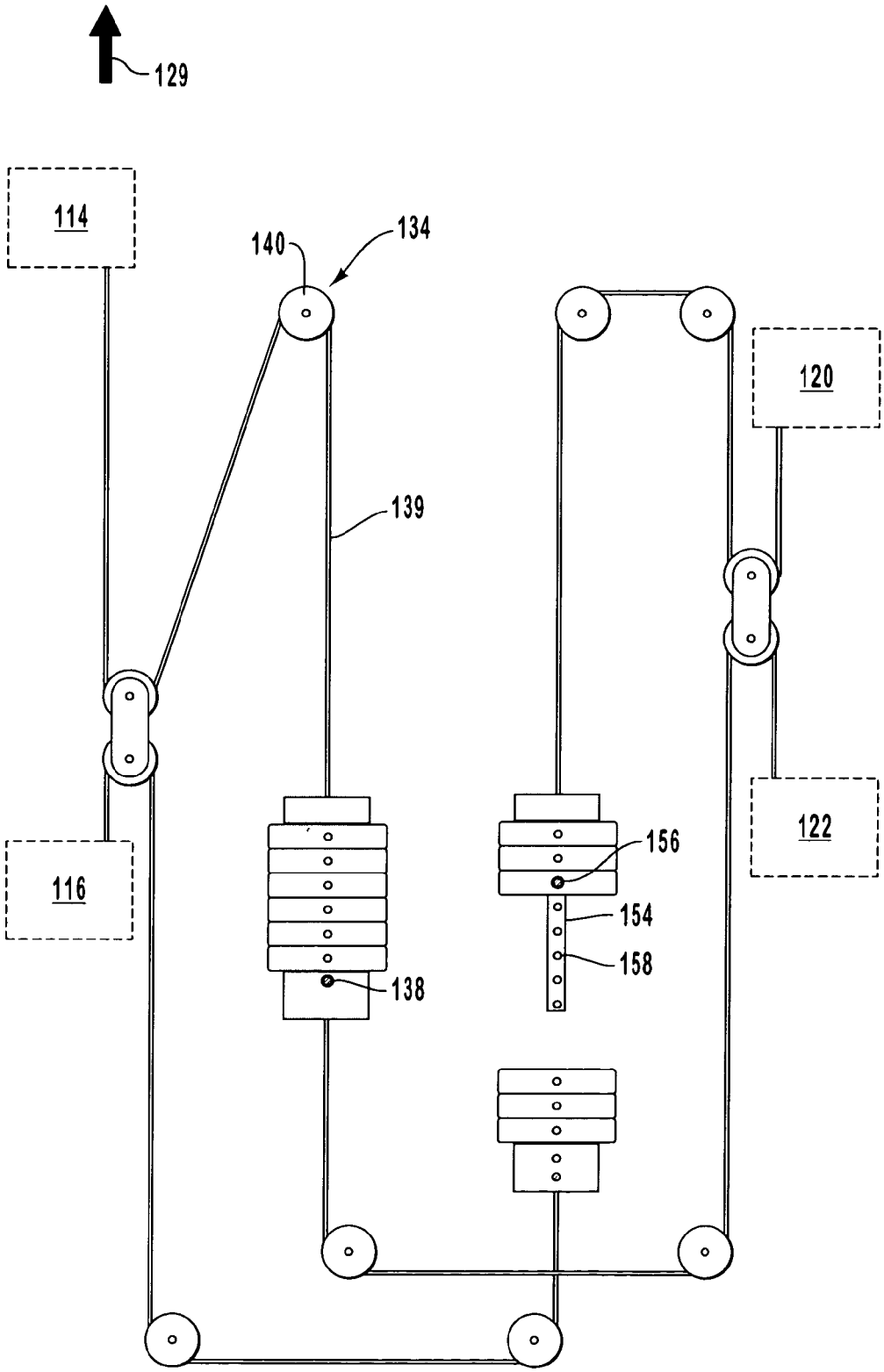
FIG. 4C is a schematic view as in FIG. 1A demonstrating the movement of both the first and second weight stacks as only one exercise station 114 is moved while the first coupling pin is mounted in the first coupling member adjacent the first weight stack.

As shown in FIG. 4C, however, and as discussed above with respect to coupling system 28, first coupling system 128*a* is configured to selectively couple first weight stack 124 and second weight stack 126 to an exercise station, such as station 114, for example. By employing coupling system 128*a*, each of the first and second weight stacks can be employed to act as resistance to a single exercise station, such as station 114.

Figure 4D:
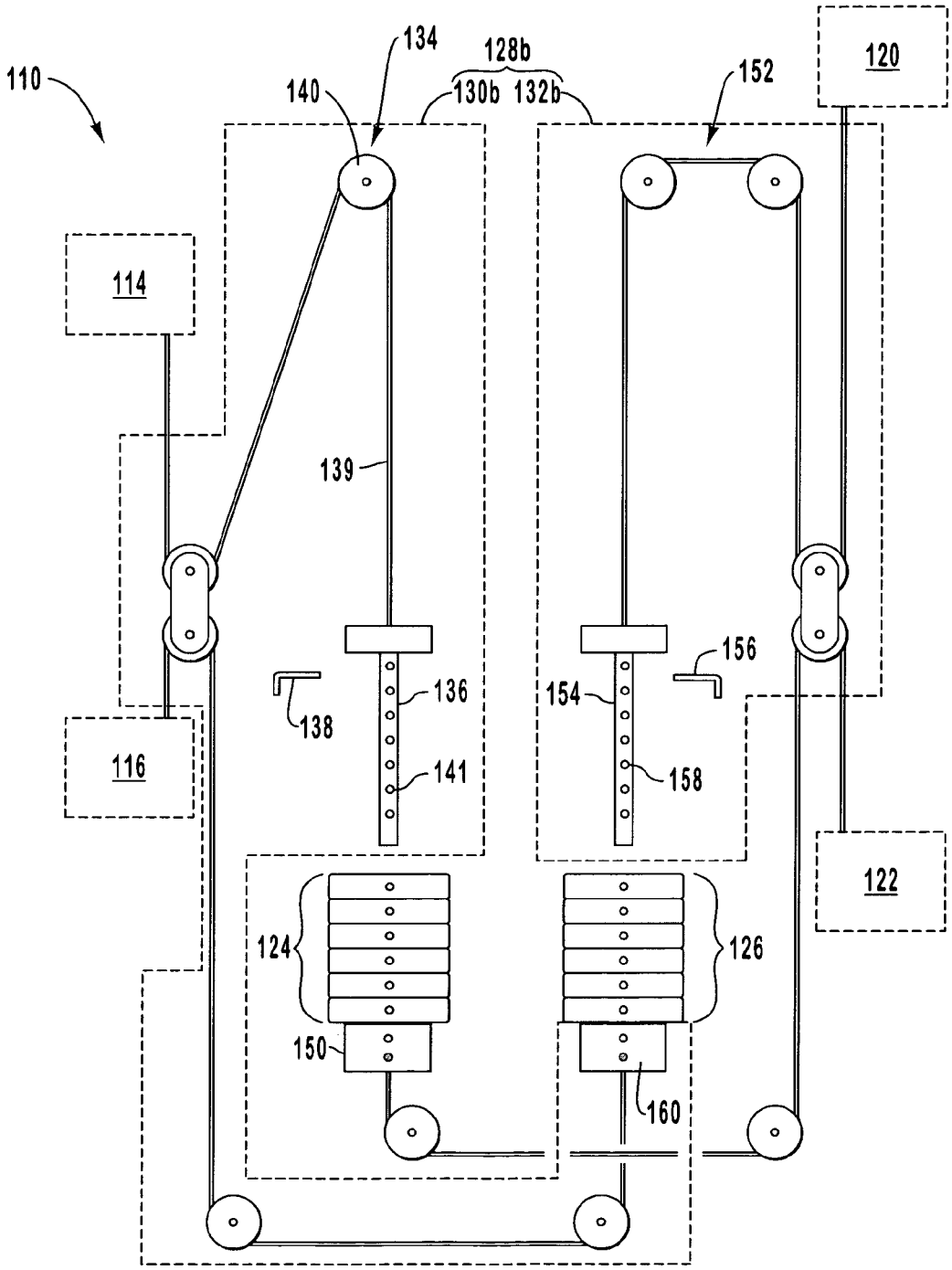
FIG. 4D is another schematic view of the exercise apparatus of FIG. 4A demonstrating that a second coupling system 128*b* allows second exercise station 120 to move both weight stacks.
Figure 4E:
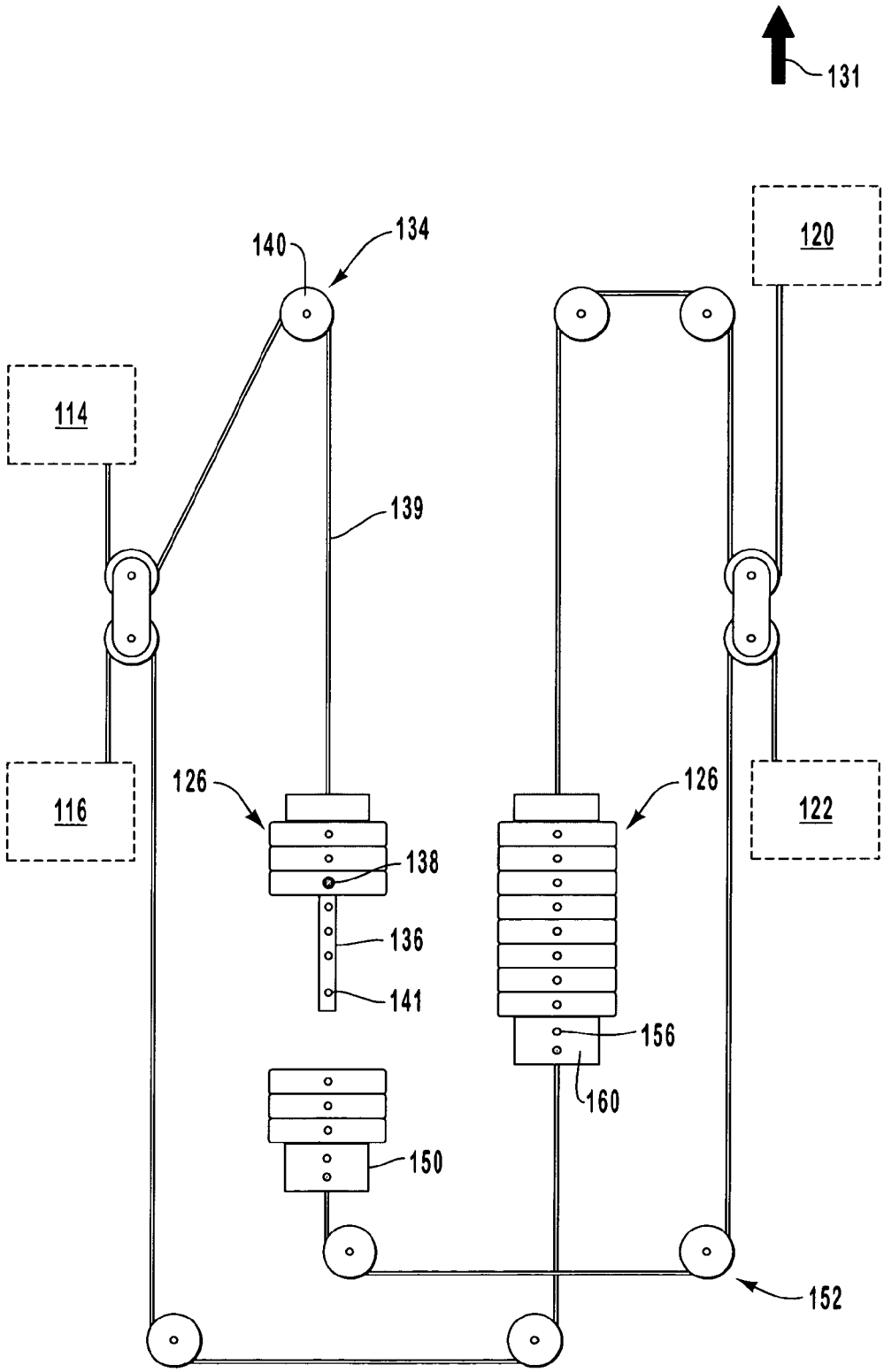
FIG. 4E is a schematic view of the appartus of FIG. 4A demonstrating the movement of both the first and second weight stacks as only one exercise station 120 is moved while the second coupling pin is mounted in the second coupling member adjacent the second weight stack.

As shown in FIGS. 4D and 4E, a second coupling system 128*a* is configured to selectively couple first weight stack 124 and second weight stack 126 to an exercise station coupled to a different cable and pulley system, such as station 120 and/or station 122, for example. By employing second coupling system 128*b*, each of the first and second weight stacks 124 and 126 can be employed to act as resistance to a single exercise station, such as station 120 and/or 122.

Apparatus 110 is thus highly efficient. Exercise station 114 may be coupled to first weight stack 124, and, if additional resistance is desired, to second weight stack 126 as well. Optionally, however, a first user may use one exercise station, e.g., station 114 coupled to first weight stack 124, while a second user uses another exercise station, e.g., station 120 coupled to second weight stack 126. As a further option, however, exercise station 120 or station 122 may be coupled to second weight stack 126, and, if additional resistance is desired, to first weight stack 124 as well. Thus, a single user of stations 120 or 122 may employ the resistance afforded by both weight stacks 124 and 126.

Returning to FIG. 4A, first coupling system 128*a* is configured to selectively couple first weight stack 124 and second weight stack 126 to exercise station 114. Coupling system 128*a* comprises: (i) a first attachment system 130*a*; and (ii) a second attachment system 132*a*.

First attachment system 130*a* selectively couples an exercise station (e.g., station 114) to first weight stack 124. Second attachment system 132*a* selectively couples second weight stack 126 to first weight stack 124 such that movement of first weight stack 124 requires movement of second weight stack 126.

First attachment system 130*a* comprises: (i) a first cable and pulley system 134 coupled to the frame; (ii) a first selector rod 136 coupled to first cable and pulley system 134; and (iii) a first selector pin 138. First cable and pulley system 134 comprises a cable 139 and one or more pulleys 140. First selector rod 136 is configured to be extended within first weight stack 124 and coupling member 150 and has a plurality of apertures 141, each configured to receive a first pin 138 therein. Pin 138 is selectively mounted in first selector rod 136 when first selector rod 136 is extended within weight stack 124.

Second attachment system 132*a* comprises (i) a first coupling member 150 selectively coupled to first selector rod 136, (ii) a second cable and pulley system 152 coupled to first coupling member 150 and the frame; (iii) a second selector rod 154 coupled to second cable and pulley system 152; and (iv) a second pin 156 selectively mounted in second selector rod 154 when rod 154 is extended within second weight stack 126.

In order to couple first weight stack 124 to second weight stack 126 the second attachment system 132*a* also comprises an additional selector pin that is selectively placed within coupling member 150. First selector pin 138 (or a third selector pin—not shown) may fulfill this function by being mounted in coupling member 150.

Second selector rod 154 is configured to be extended within second weight stack 126 and has a plurality of apertures 158 configured to receive second pin 156 therein. Coupling member 150 may be configured the same as or similar to member 50 discussed above, for example FIG. 4B demonstrates the independent movement of the first and second weight stacks 124, 126 as respective exercise stations are moved with the first and second coupling pins 138, 156 mounted in respective third weight plates. As shown in FIG. 4B, in one embodiment, pin 138 is coupled to first stack 124 and selector pin 136, thereby allowing weight stack 124 to move independently from weight stack 126, as shown in FIG. 4B. Similarly, second pin 156 is coupled to second stack 126.

However, as shown in FIG. 4C, when desired by an exerciser, movement of a single exercise station e.g., station 114 requires movement of at least one plate from each of first weight stack 124; and (ii) second weight stack 126. Upon mounting coupling pin 138 within coupling member 150, plates from second weight stack 126 can be coupled to first weight stack 124 through the use of pin 156, as shown in FIG. 4C.

First coupling system 128*a* is thus another example of means for coupling a first resistance assembly (e.g., weight stack 124) to an exercise station and for coupling a second resistance assembly (e.g., weight stack 126) to the first resistance assembly, such that movement of the exercise station requires movement of at least a portion (e.g., a plate) from each of: (i) the first resistance assembly; and (ii) the second resistance assembly.

As mentioned above, and as shown in FIGS. 4D and 4E, a second coupling system 128*b* is configured to selectively couple first weight stack 124 and second weight stack 126 to an exercise station coupled to second cable and pulley system 152. By employing second coupling system 128*b*, each of the first and second weight stacks 124 and 126 can be employed to act as resistance to a single exercise station, such as station 120 and/or 122.

With continued reference to FIG. 4D, second coupling system 128*b* comprises: (i) a primary attachment system 132*b*; and (ii) a secondary attachment system 130*b*.

Primary attachment system 132*b* selectively couples an exercise station (e.g., station 120) to second weight stack 126. Secondary attachment system 130*b* selectively couples first weight stack 124 to second weight stack 126 such that movement of second weight stack 126 requires movement of first weight stack 124. Primary attachment system 132*b* comprises: (i) cable and pulley system 152 coupled to the frame; (ii) selector rod 154 coupled to cable and pulley system 152; and (iii) selector pin 156. Secondary attachment system 130*a* comprises (i) a coupling member 160 selectively coupled to selector rod 154, (ii) cable and pulley system 134 coupled to coupling member 160 and the frame; (iii) selector rod 136 coupled to cable and pulley system 152*b*; and (iv) pin 138 selectively mounted in selector rod 136 when rod 136 is extended within second weight stack 126.

In order to couple first weight stack 124 to second weight stack 126, the secondary attachment system 130*a* also comprises an additional selector pin that is selectively placed within coupling member 160. For example, pin 156 or a third pin (not shown) may be employed to couple member 160 to rod 154 when rod 154 is moved into coupling member 160.

Coupling member 160 can be configured identical or similar to coupling member 50 discussed above. Coupling member 160 is positioned below second weight stack 126 and moves vertically with second weight stack 126 when coupling member 160 is coupled to selector rod 154.

As shown in FIG. 4E, upon mounting pin 156 within coupling member 160 and upon mounting pin 138 in stack 126, movement of a single exercise station e.g., station 120 requires movement of at least one plate from each of first weight stack 124; and (ii) second weight stack 126.

Second coupling member 160 is thus part of second coupling system 128*b*. Second coupling system 128*b* is an example of means for coupling a first resistance assembly to an exercise station and for coupling a second resistance assembly to the first resistance assembly, such that movement of the exercise station requires movement of at least a portion from each of: (i) the first resistance assembly; and (ii) the second resistance assembly.

Thus, in the embodiment of FIGS. 4A–4E, a first exercise station (e.g., 114) is selectively coupled to the first and second weight stacks and a second exercise station (e.g., 120) employing a different pulley and cable system is selectively coupled to the first and second weight stacks. In this embodiment, each exercise station coupled to one cable and pulley system is capable of moving either the first weight stack or the first and second weight stacks and each exercise station coupled to another cable and pulley system is also capable of moving either the second or the first and second weight stacks.

The weight stacks described herein are examples of resistance assemblies that may be employed in the present invention. A portion of each such resistance assembly is moved when one plate from the stack is moved, for example. Other resistance assemblies may be employed in the present invention, however, such as a shock (e.g., a gas shock), elastic member (e.g., an elastic band), leaf spring, coil, flexible rod or strip, or other resistance assembly that provides resistance to movement of an exercise station coupled to the assembly.

FIG. 3 demonstrates an example of a system for coupling the exercise stations to the weight stacks in accordance with the schematic versions of FIGS. 4A–4E. The exercise stations 114–122 are numbered in FIG. 3 according to a possible configuration of the stations in accordance with FIGS. 4A–4E. However, it will be appreciated that these particular configurations are not necessary for the functioning of the exercise apparatus of the present invention and a variety of different configurations may be employed.

In FIG. 3, first selector pin 138 is mounted within coupling member 150 such that movement of any of exercise stations 114 or 116 results in movement of both weight stack 124 and 126 as discussed above with regard to FIGS. 4A–4E. In one embodiment of FIG. 3, exercise station 114 comprises an arm press mechanism, exercise station 116 comprises a leg curl mechanism, and exercise stations 120 and 122 comprise an upper handle and a sliding chair mechanism, respectively.

System 110 may also comprise additional exercise stations and cables and pulleys. For example, additional stations 120*a–c* of FIG. 3 are shown in phantom lines. The cables coupled to these stations 120*a–c* may have a variety of different cable paths. For example, the cable portion (shown partially in phantom lines) coupled to station 120*a* may be coupled directly or indirectly to the cable portion coupled to station 120 and/or parallel at least a portion of the path of the cable portion that extends between the selector rod and station 120. In one embodiment, each of the cable portions coupled to stations 120*a–c* couple directly or indirectly to the cable portion coupled to station 120 (or optionally, the cable portion coupled to station 122). Thus, the cable portion coupled to a station such as station 120 (or another station, e.g., station 122) may also have one or more additional stations (e.g., 120*a–c*) coupled thereto. Furthermore, additional cable(s) and pulley(s) may be added to those shown explicitly in FIG. 3 to connect stations such as stations 120*a–c* or other stations to a weight stack, e.g., stack 126. Station 120*c* may include a handle coupled thereto or another member or mechanism. A vast number of other exercise stations may also be employed in place of any of stations shown in FIG. 3.

Thus, the exercise stations, cables, pulleys, and frame shown in FIG. 3 are only provided to illustrate certain embodiments out of the vast cornucopia of possible exercise stations, cables, pulleys, and frames that may be employed in the present invention in light of the general concepts disclosed herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An exercise apparatus having an exercise station that is selectively moved by a user and having first and second resistance assemblies that selectively provide resistance to movement of the exercise station, the exercise apparatus comprising:

a frame;

an exercise station;

a first resistance assembly including a first weight stack;

a second resistance assembly including a second weight stack; and a coupling system configured to couple the first resistance assembly to an exercise station and to couple the second resistance assembly to the first resistance assembly, such that movement of the exercise station requires movement of at least a portion from each of: (i) the first resistance assembly, and (ii) the second resistance assembly, wherein the coupling system comprises: (i) a first attachment system selectively coupling the exercise station to the first weight stack; and (ii) a second attachment system selectively coupling the second weight stack to the first weight stack, such that movement of the first weight stack requires movement of the second weight stack, wherein the first attachment system comprises: (i) a first cable and pulley system coupled to the frame; (ii) a first selector rod coupled to the first cable and pulley system, the first selector rod configured to be extended within the first weight stack and having a plurality of apertures configured to receive a first pin therein; and (iii) a pin selectively mounted in the first selector rod when the first selector rod is extended within the weight stack, and wherein the second attachment system comprises: (i) a first coupling member selectively coupled to the first selector rod, the member configured to receive the first selector rod through an aperture therein; (ii) a second cable and pulley system coupled to the first coupling member and the frame; (iii) a second selector rod coupled to the second cable and pulley system, the second selector rod configured to be extended within the second weight stack and having a plurality of apertures configured to receive a second pin therein; and (iv) a second pin selectively mounted in the second selector rod when the second selector rod is extended within the second weight stack.

2. An exercise apparatus as recited in claim 1, wherein movement of at least a portion of the first resistance assembly comprises movement of at least one weight in the first weight stack, and wherein movement of at least a portion of the second resistance assembly comprises movement of at least one weight in the second weight stack.

3. An exercise apparatus as recited in claim 1, further comprising a second coupling member configured to selectively couple the first resistance assembly to the second resistance assembly.

4. An exercise apparatus as recited in claim 1, wherein the first coupling member is positioned below the first weight stack and moves vertically with the first weight stack when the coupling member is coupled to the first selector rod.

5. An exercise apparatus as recited in claim 1, wherein each of the first and second weight stacks move along a different axis.

6. An exercise apparatus as recited in claim 1, wherein each weight stack comprises at least one weight.

7. An exercise apparatus as recited in claim 1, wherein each weight stack comprises a plurality of vertically stacked weights.

8. An exercise apparatus as recited in claim 1, further comprising means for coupling: (i) the first weight stack; and (ii) the second weight stack to a second exercise station such that movement of the second exercise station requires movement of both (i) the first weight stack; and (ii) the second weight stack.

9. An exercise apparatus as recited in claim 8, wherein said means for coupling: (i) the first weight stack; and (ii) the second weight stack to the second exercise station comprises a second coupling system.

10. An exercise apparatus as recited in claim 9, wherein the second coupling system comprises a coupling member configured to couple the second weight stack to the first weight stack.

11. An exercise apparatus having (i) an exercise station that is selectively moved by a user, and (ii) first and second resistance assemblies that selectively provide resistance to movement of the exercise station, the exercise apparatus comprising:

a frame;

an exercise station;

a first resistance assembly;

a second resistance assembly; and a coupling system configured to couple the first resistance assembly to the exercise station and to selectively couple the second resistance assembly to the first resistance assembly, such that movement of the exercise station requires movement of at least a portion from each of: (i) the first resistance assembly; and (ii) the second resistance assembly, wherein the coupling system comprises: (i) a first cable and pulley system coupled to the frame; (ii) a first selector rod coupled to the first cable and pulley system, the first selector rod configured to be selectively coupled to the first resistance assembly; (iii) a second cable and pulley system coupled to the frame; (iv) a second selector rod coupled to the second cable and pulley system, the second selector rod configured to be selectively coupled to the second resistance assembly; and (v) a first coupling member selectively coupled to the first selector rod, the member configured to receive the first selector rod through an aperture therein.

12. An exercise apparatus as recited in claim 11, wherein the coupling system further comprises a second coupling member selectively coupled to the second selector rod, the second member configured to receive the second selector rod through an aperture therein to selectively couple the first resistance assembly to the second resistance assembly.

13. An exercise apparatus as recited in claim 11, wherein the first resistance assembly comprises a first weight stack and wherein the second resistance assembly comprises a second weight stack, and wherein movement of at least a portion of the first resistance assembly comprises movement of at least one weight in the first weight stack, and wherein movement of at least a portion of the second resistance assembly comprises movement of at least one weight in the second weight stack.

14. An exercise apparatus having: (i) an exercise station that is selectively moved by a user; and (ii) first and second resistance assemblies that selectively provide resistance to movement of the exercise station, the exercise apparatus comprising:

a frame;

an exercise station;

a first resistance assembly;

an attachment system configured to couple the first resistance assembly to the exercise station, the attachment system comprising a cable and pulley system to facilitate coupling of the first resistance assembly to the exercise station, wherein the exercise station and the first resistance assembly are each linked to the cable and pulley system;

a second resistance assembly that is selectively coupled to the first resistance assembly such that when coupled, movement of the first exercise station requires movement of at least a portion from each of the first resistance assembly and the second resistance assembly; and a second exercise station selectively coupled to the second resistance assembly, such that movement of the second exercise station requires movement of the second resistance assembly independent of the first resistance assembly.

15. An exercise apparatus as recited in claim 14, further comprising a coupling member configured to couple the second resistance assembly to the first resistance assembly.

16. An apparatus as recited in claim 14, wherein the first resistance assembly comprises a first weight stack and wherein the second resistance assembly comprises a second weight stack, and wherein movement of the second resistance assembly comprises movement of at least one weight in the second weight stack.

17. An exercise apparatus having an exercise station that is selectively moved by a user and having first and second resistance assemblies that selectively provide resistance to movement of the exercise station, the exercise apparatus comprising:

a frame;

an exercise station;

a first resistance assembly;

a second resistance assembly;

a coupling system configured to selectively couple the exercise station to the first resistance assembly and to selectively couple the second resistance assembly to the first resistance assembly, such that movement to the exercise station requires movement of at least a portion from each of: (i) the first resistance assembly; and (ii) the second resistance assembly; the coupling system comprising a cable and pulley system coupled to the frame and a selector rod coupled to the cable and pulley system, the selector rod configured to be selectively coupled to the first resistance assembly; and a second exercise station that is selectively coupled to the second resistance assembly, such that movement of the second exercise station requires movement of the second resistance assembly independent of the first resistance assembly.

18. An exercise apparatus as recited in claim 17, wherein the first resistance assembly comprises a first weight stack and wherein the second resistance assembly comprises a second weight stack, and wherein movement of at least a portion of the first resistance assembly comprises movement of at least one weight in the first weight stack, and wherein movement of at least a portion of the second resistance assembly comprises movement of at least one weight in the second weight stack.

19. An exercise apparatus as recited in claim 17, further comprising a coupling member configured to couple the second resistance assembly to the first resistance assembly.

20. An exercise apparatus having an exercise station that is selectively moved by a user and having first and second resistance assemblies that selectively provide resistance to movement of the exercise station, the exercise apparatus comprising:

a frame;

an exercise station;

a first resistance assembly;

an attachment system configured to couple the first resistance assembly to the exercise station, the attachment system comprising a cable and pulley system and a selector rod coupled to the cable and pulley system, the selector rod configured to be selectively coupled to the first resistance assembly;

a second resistance assembly;

a coupling member configured to selectively couple the first resistance assembly to the second resistance assembly, the coupling member selectively coupled to the selector rod, the coupling member selectively receiving the selector rod therein.

21. An exercise apparatus as recited in claim 20, wherein the first resistance assembly comprises a first weight stack and wherein the second resistance assembly comprises a second weight stack, and wherein movement of at least a portion of the first resistance assembly comprises movement of at least one weight in the first weight stack, and wherein movement of at least a portion of the second resistance assembly comprises movement of at least one weight in the second weight stack.

22. An exercise apparatus having an exercise station that is selectively moved by a user and having first and second weight stacks that provide selected resistance to movement of the exercise station, the exercise apparatus comprising:

a frame;

a first exercise station;

a second exercise station;

a first weight stack configured to be selectively moved by the first exercise station;

a second weight stack configured to be selectively moved by the second exercise station;

a first coupling system configured to couple: (i) the first weight stack; and (ii) the second weight stack to the first exercise station such that movement of the first exercise station requires movement of at least one plate from each of: (i) the first weight stack; and (ii) the second weight stack, wherein the first coupling system comprises a first coupling member that selectively couples the first weight stack to the second weight stack and a cable and pulley system to facilitate coupling of the first weight stack to the first exercise station, wherein the first exercise station and the first weight stack are each linked to the cable and pulley system; and a second coupling system configured to couple: (i) the first weight stack; and (ii) the second weight stack to the second exercise station such that movement of the second exercise station requires movement of at least one plate from each of: (i) the first weight stack; and (ii) the second weight stack, wherein the second coupling system comprises a second coupling member that selectively couples the second weight stack to the first weight stack.

* * * * *

UNITED STATES PATENT AND TRADEMARK OFFICE

CERTIFICATE OF CORRECTION

PATENT NO. : 7,044,897 B2
APPLICATION NO. : 09/990178
DATED : May 16, 2006
INVENTOR(S) : Myers et al.

It is certified that error appears in the above-identified patent and that said Letters Patent is hereby corrected as shown below:

Column 5
Line 11, change "FIG. 2" to --FIG. 1B--

Column 7
Line 8, change "second" to --first--
Line 9, change "first" to --second--
Line 67, before "152" remove "."

Column 8
Line 31, change "128a" to --128b--

Column 9
Line 30, change "pin" to --rod--

Column 10
Line 3, change "130a" to --130b--
Line 7, change "152b" to --134--
Line 8, change "second" to --first--
Line 9, change "126" to --124--
Line 11, change "130a" to --130b--
Line 24, change "126" to --124--
Line 67, change "stack" to --stacks--

Signed and Sealed this

Third Day of April, 2007

JON W. DUDAS
*Director of the United States Patent and Trademark Office*